United States Patent [19]

Okamoto

[11] 3,941,469

[45] Mar. 2, 1976

[54] DRY TYPE DEVELOPING DEVICE FOR A COPYING APPARATUS OR LIKE APPARATUS

[75] Inventor: Toyoo Okamoto, Tokyo, Japan

[73] Assignee: Ricoh Co., Ltd., Tokyo, Japan

[22] Filed: Apr. 23, 1974

[21] Appl. No.: 463,365

[30] Foreign Application Priority Data

May 1, 1973 Japan ..... 48-49481

[52] U.S. Cl. ..... 355/3 DD

[51] Int. Cl.[2] ..... G03G 15/00

[58] Field of Search ..... 355/3

[56] References Cited

UNITED STATES PATENTS 3,837,741 9/1974 Spencer ..... 355/3

*Primary Examiner*—John M. Horan

*Attorney, Agent, or Firm*—Cooper, Dunham, Clark, Griffin & Moran

[57] ABSTRACT

A dry type developing device built in a copying apparatus or like apparatus for developing an electrostatic latent image formed on a copy sheet by means of a magnetic brush wherein the device is provided with sheet guide means and receiver means which have the effect of ensuring proper contact of the copy sheet with the magnetic brush by keeping the copy sheet from invading and moving through, or moving with parts of the image being kept out of contact with, the layer of toner particles magnetically held in place on the peripheral surface of a toner supply drum in the developing station. Soiling of the underside of the copy sheet by toner particles or partial non-developing or under-developing of the latent image can be prevented, so that the toner image formed is high in quality and free from irregularities in density.

6 Claims, 4 Drawing Figures

DRY TYPE DEVELOPING DEVICE FOR A COPYING APPARATUS OR LIKE APPARATUS

BACKGROUND OF THE INVENTION

This invention relates to a dry type developing device for a copying apparatus or like apparatus, and more particularly it is concerned with a dry type developing device for developing a copy sheet on which an electrostatic latent image is formed by means of a magnetic brush, which device is provided with means for ensuring proper contact of the copy sheet with the magnetic brush so as to prevent soiling of the underside of the copy sheet or partial under-developing or non-developing of the electrostatic latent image.

The magnetic brush developing method is a dry type electrophotographic developing method which consists in supplying a magnetic developing agent to a magnetic brush forming roller which may be a magnetic roller or a non-magnetic roller having magnets built therein so as to form a magnetic brush, and rubbing the surface of the copy sheet supporting an electrostatic latent image thereon by the magnetic brush to supply toner particles to the electrostatic latent image to develop and render the same visible.

When this developing method is employed, an electrophotosensitive sheet, electrostatic recording sheet or other sheet (hereinafter referred to as a copy sheet) is fed to the magnetic brush and brought into contact therewith. It has hitherto been customary to supply the copy sheet directly to the magnetic brush, so that the manner in which the copy sheet is brought into contact with the magnetic brush may vary depending on the firmness of the sheet. When the copy sheet lacks firmness, the copy sheet is not brought into contact with the magnetic brush along the full width of the sheet and some regions of the latent image may remain non- or under-developed, so that there occur irregularities in the density of the toner image. When the copy is too firm, the leading end invades the layer of toner particles and moves therethrough and some toner particles move to the underside of the copy sheet, with the result that the underside of the copy sheet is soiled.

To remove the toner particles adhering to the underside of the copy sheet and soiling the same, it has hitherto been customary to employ a pump or magnet to draw off the toner particles by suction. This is disadvantageous in that the developing device becomes complex in construction and high in cost.

SUMMARY OF THE INVENTION

This invention obviates the aforementioned disadvantages of the prior art. Accordingly, the invention has as its object the provision of a dry developing device for a copying apparatus or like apparatus in which receiver means is provided for a copy sheet and disposed in spaced juxtaposed relation to the peripheral surface of the magnetic brush forming roller with a constant clearance being interposed therebetween, and in which the copy sheet is moved toward the receiver means by guide means and not toward the magnetic brush as has hitherto been practised.

The present invention has the advantage that the copy sheet is maintained with its underside in contact with the receiver means while moving through the developing station, so as to ensure proper contact of the upper surface of the copy sheet with the surface of the layer of toner particles on the magnetic brush forming roller along the entire width without the leading end of the copy sheet invading the magnetic brush, thereby preventing soiling of the underside of the copy sheet. Another advantage obtained is that, because the clearance between the magnetic brush forming roller and the receiver means is constant, even distribution of toner particles from the magnetic brush to the copy sheet can be ensured, so that the visible image obtained by developing the electrostatic latent image is free from irregularities in density and therefore high in quality.

DESCRIPTION OF A PREFERRED EMBODIMENT

Figure 1:
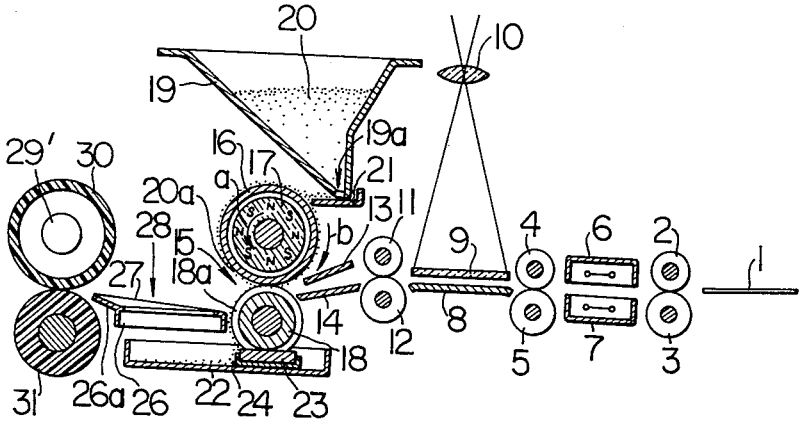
FIG. 1 is a schematic vertical sectional view of a copying apparatus of the dry type incorporating therein the principles of this invention.

In FIG. 1, a copy sheet 1 comprises an electrically conductive supporter which may be a sheet of paper treated to become conductive, for example, and a layer of a photosensitive composition disposed on the electrically conductive supporter, such layer being principally made up of zinc oxide, poly-N-vinylcarbazole or other photoconductive material. Such copy sheet 1 is delivered by two pairs of delivery rollers 2, 3 and 4, 5 and has its entire upper surface or its photosensitive layer electrically charged uniformly by charging means 6, 7 interposed between the two pairs of delivery rollers 2, 3 and 4, 5 while being delivered thereby.

The copy sheet 1 which has thus been electrically charged while moving reaches a guide plate 8 on which a target glass sheet 9 is disposed. When the copy sheet 1 is disposed on the guide plate 8, it is exposed to an optical image of an original to be copied through the target glass sheet 9 by means of a projecting optical system comprising a projection lens 10 as its main component. Thus, an electrostatic latent image of the original is formed on the photosensitive layer of the copy sheet 1.

When the copy sheet used in the invention is not an electrophotographic photosensitive sheet but a well-known electrostatic recording sheet, an electrostatic latent image of the original is formed on the copy sheet by transfer printing from an electrostatic latent image formed on a photosensitive drum or by impression of a voltage through a contact electrode.

The copy sheet 1 on which the electrostatic latent image is formed as aforementioned is delivered by yet another pair of delivery rollers 11, 12 to guide means 13, 14 which guides the copy sheet 1 in its movement toward a developing station 15.

In the developing station 15, there is disposed a hollow magnetic brush forming roller 16 made of aluminum or other nonmagnetic material and containing a magnet roller 17 therein. A receiver roller 18 is disposed beneath the roller 16 and disposed in spaced juxtaposed relation thereto.

The magnet roller 17 comprises a number of magnetic poles arranged side by side on its peripheral surface and is adapted to rotate at a constant rate in the direction of an arrow *a*. It is to be understood that the magnetic brush forming roller 16 is fixed and not rotatable.

Disposed above the magnetic brush forming roller 16 is a developing agent container 19 which contains a dry developing agent 20 therein. The dry developing agent 20 may be a mixture of a toner and a carrier which may be particles of iron or other ferromagnetic material, or may consist of toner particle each comprising therein a ferromagnetic material in powder form as its nucleus.

The developing agent container 19 is funnel-shaped in cross-section and formed with a slit-shaped opening 19*a* at its bottom. A developing agent guide and doctor plate 21 disposed immediately beneath the opening 19*a* extends horizontally toward the upper right portion of the roller 16 in the figure. The dry developing agent 20 dropping through the opening 19*a* is delivered in a constant amount to the peripheral surface of the roller 16 as the agent 20 is attracted by the magnetic force of the magnet roller 17 and moves on the guide and doctor plate 21. The dry developing agent 20 supplied to the peripheral surface of the roller 16 forms a magnetic brush 20 thereon, with the dry developing agent 20 moving by rolling motion, in virtue of the rotation of the magnet roller 17, along the periphery of the roller 16 in a direction *b* opposite to the direction of rotation *a* of the roller 17. It should be understood that other suitable known means may be used for forming a magnetic brush.

Figure 3:
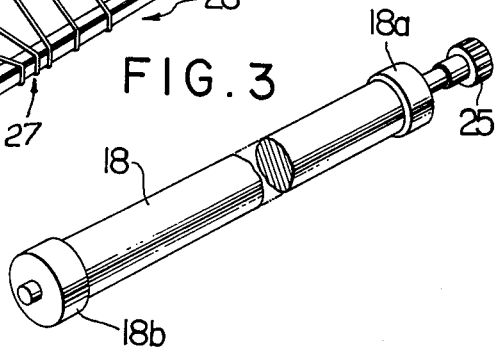
FIG. 3 is a perspective view of the receiver or receiver roller according to the invention.

The receiver roller 18 which is made of aluminum, austenite stainless steel or other non-magnetic material is rotatably disposed beneath the magnetic brush forming roller 16. According to the invention, the clearance between the peripheral surface of the receiver roller 18 and the peripheral surface of the magnetic brush forming roller 16 is set at a constant level. That is, the clearance has a value which is smaller than the sum of the average height of the magnetic brush 20*a* and the thickness of the copy sheet 1. For example, when the magnetic brush 20*a* formed by the doctoring action of the plate 21 has a height of 0.4 millimeter, the clearance between the two peripheral surfaces is 0.6 millimeter. In order to maintain the clearance between the peripheral surfaces of the two rollers 16 and 18 at a constant level, flanges 18*a*, 18*b* are formed at opposite ends of the receiver roller 18 and each have a height corresponding to the value of the clearance or spacing. By maintaining the flanges 18*a*, 18*b* in contact with the peripheral surface of the roller 16, the clearance or spacing between the two rollers 16 and 18 can be maintained at the desired level (See FIG. 3).

Figure 4:
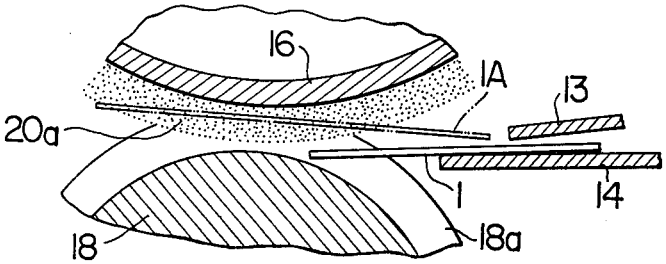
FIG. 4 is a sectional view, on an enlarged scale, of the developing station of the copying apparatus shown in FIG. 1.

The receiver roller 18 constructed and disposed as aforementioned is rotated from a drive source through a gear 25. As shown in FIG. 4, the guide means 13, 14 is disposed with respect to the receiver roller 18 such that the copy sheet 1 delivered to the developing station 15 by the delivery rollers 11, 12 forms an acute angle with the peripheral surface of the roller 18. By this arrangement, the copy sheet 1 is permitted to move between the rollers 16 and 18 while keeping its underside in contact with the peripheral surface of the receiver roller 18. This avoids the floating of the copy sheet 1 as indicated at a dash-and-dot line position 1A and the copy sheet is kept from moving through the layer of toner particles on the peripheral surface of the roller 16. Thus, even distribution of the dry developing agent 20 to the entire surface of the copy sheet 1 is ensured, and the electrostatic latent image thereon can be developed into a visible image of high quality. While the guide means 13, 14 is shown as comprising a pair of plates, it should be understood that such means may comprise a pair of rollers within the scope of the invention.

Disposed beneath the receiver roller 18 is a tray 22 which has affixed to its bottom through a supporter 24 a pad 23 adapted to come into contact with the peripheral surface of the receiver roller 18. The pad 23, which may be made of felt, sponge rubber or like material, performs the function of cleaning the roller 18 and removing a small amount of dry developing agent which might otherwise adhere to the peripheral surface of the roller 18. There is almost no need to clean the receiver roller 18, however, so that it may be a fixed roller instead of being a rotatable roller. Alternatively, a receiver in plate form may be employed in place of the receiver roller 18 as receiver means.

Figure 2:
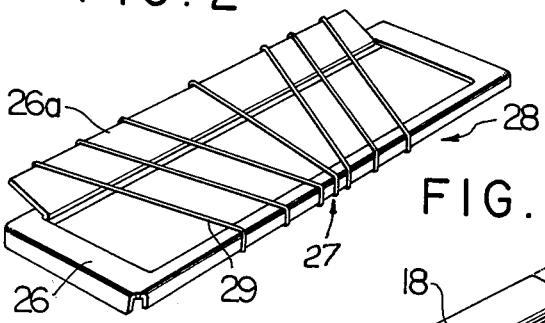
FIG. 2 is a perspective view of the sieve means used in the copying apparatus shown in FIG. 1.

Sieve means 28 comprising a net 27 and a support frame 26 supporting the net 27 thereon is disposed leftwardly of the receiver roller 18 as shown in FIG. 1. The tray 22 has a length such that the sieve means 28 is disposed above a portion of the tray 22 that disposed opposite to the portion thereof above which the receiver roller 18 is disposed. FIG. 2 shows the construction of the sieve means 28 in detail. As shown, the support frame 26 is formed at one end thereof with an upwardly directed inclined portion 26*a*, and the net 27 includes a string 29 radially wound around the frame 26.

The sieve means 28 is disposed such that the upwardly directed inclined portion 26*a* is disposed on the downstream side along the path of movement of the copy sheet 1. Thus, the copy sheet 1 moving along its path of movement has its underside rubbed by the sieve means 28 so as to remove therefrom the dry developing agent which might otherwise adhere thereto. By arranging the string 29 as shown in FIG. 2, it is possible to effectively rub the underside of the copy sheet 1 while permitting the same to move smoothly thereon. It is to be understood that the invention is not limited to the specific form of the sieve means and that any known form of sieve means may be employed. For example, the net 27 or string 29 may be a thin metallic wire or a yarn of synthetic resinous material. Since a very small amount of the dry developing agent would adhere to the underside of the copy sheet 1, the sieve means 28 may be dispensed with.

After the electrostatic latent image on the copy sheet 1 is developed into a visible toner image, the copy sheet 1 is passed between a heating roller 30 made of a silicone rubber or like material and having a heating source 29' built therein and a pressure roller 31 so that the toner image may be fixed. Thus, a copy of the original is produced and discharged from the apparatus. It is to be understood that any other form of fixing means may be employed to fix the toner image on the copy sheet 1.

What is claimed is:

1. A dry type developing apparatus or like apparatus wherein an electrostatic latent image formed on a copy sheet is developed into a visible image by means of a magnetic brush technique, comprising in combination:

a toner supply member;

means for magnetically forming on the surface of said supply member a toner layer functioning as a magnetic brush;

means for maintaining said toner layer at a predetermined height;

means for continuously moving said magnetic brush through a developing station;

receiver means of a non-magnetic material disposed in spaced juxtaposed relation to said toner supply member and having a surface for receiving a copy sheet moving into the developing station and spaced apart from said surface of said toner supply member a predetermined distance greater than said predetermined height for bringing the electrostatic latent image on the copy sheet into contact with the surface of the toner layer in such a manner as to prevent the copy sheet from invading the toner layer or portions thereof from being kept out of contact with the toner layer; and guide means disposed on the upstream side of said receiver means for guiding the copy sheet onto said surface of said receiver means in a manner such that the copy sheet forms an acute angle with said receiver means.

2. A dry type developing device as claimed in claim 1 wherein said receiver means comprises a roller rotatable in a direction to cause the copy sheet to move through the developing station.

3. A dry type developing device as claimed in claim 2 further comprising:

means for cleaning the surface of said roller while it rotates.

4. A dry type developing device as claimed in claim 2 wherein said roller is formed with a flange at each end maintained in contact with a portion of said toner supply member at all times during rotation so as to ensure that the surfaces of the toner supply member and the roller are spaced apart from each other a predetermined distance.

5. A dry type developing device as claimed in claim 1 further comprising sieve means disposed downstream of said developing station for receiving the rear surface of said copy sheet after development.

6. A dry type developing device as claimed in claim 5 wherein said sieve means comprises a support frame formed at one end with an upwardly inclined portion and a string wound around said support frame.

* * * * *